United States Patent [19]

Bosco et al.

[11] 4,348,829

[45] Sep. 14, 1982

[54] WEATHER SHIELD FOR THE FIRING MECHANISM OF A GUN AND ITS METHOD OF MANUFACTURE

[76] Inventors: Lewis R. Bosco, P.O. Box 189, East Berlin, Pa. 17316; Richard J. Bosco, Hampton Ct., Butler, Pa. 16001

[21] Appl. No.: 123,943

[22] Filed: Feb. 22, 1980

[51] Int. Cl.[3] ..... F41C 27/08

[52] U.S. Cl. ..... 42/1 N

[58] Field of Search ..... 42/1 N, 1 Y, 1 R, 83, 42/70 F, 70 R, 51

[56] References Cited

U.S. PATENT DOCUMENTS

| | | | |
|---|---|---|---|
| 28,109 | 5/1860 | Singleton | 42/83 |
| 35,456 | 6/1862 | Leverich | 42/1 N |
| 91,014 | 6/1869 | Hay et al. | 42/83 |
| 137,381 | 4/1873 | Morris | 42/69 R |
| 521,533 | 6/1894 | Campbell | 42/83 |
| 1,320,888 | 11/1919 | Miller et al. | 42/1 R |
| 2,364,340 | 12/1944 | Bogg, Jr. | 42/1 N |
| 2,932,334 | 4/1960 | Steen | 42/1 N |
| 3,022,596 | 2/1962 | Cannon | 42/1 Y |
| 3,616,559 | 11/1971 | Sobolewski | 42/1 Y |

FOREIGN PATENT DOCUMENTS

| | | | |
|---|---|---|---|
| 117 | 8/1899 | Austria | 42/1 Y |
| 22134 | 12/1920 | France | 42/1 N |

*Primary Examiner*—Charles T. Jordan

*Attorney, Agent, or Firm*—Stevens, Davis, Miller & Mosher

[57] ABSTRACT

Disclosed is a removable weather shield for protecting the exterior firing mechanism, including hammer structure of a gun. The weather shield is formed as a generally C-cross sectional shaped elongated resilient body having a curved top and depending sidewalls which is contoured to the profile of a portion of a gun containing the exterior firing mechanism. The body defines an interior hollow area having a widthwise dimension slightly smaller than the widthwise dimension of the portion of a gun about which the shield is to be mounted to provide a natural gripping of the shield to the gun. A method of manufacturing the shield, which includes the step of molding a heated thermoplastic material about the firing mechanism, is also disclosed.

5 Claims, 6 Drawing Figures

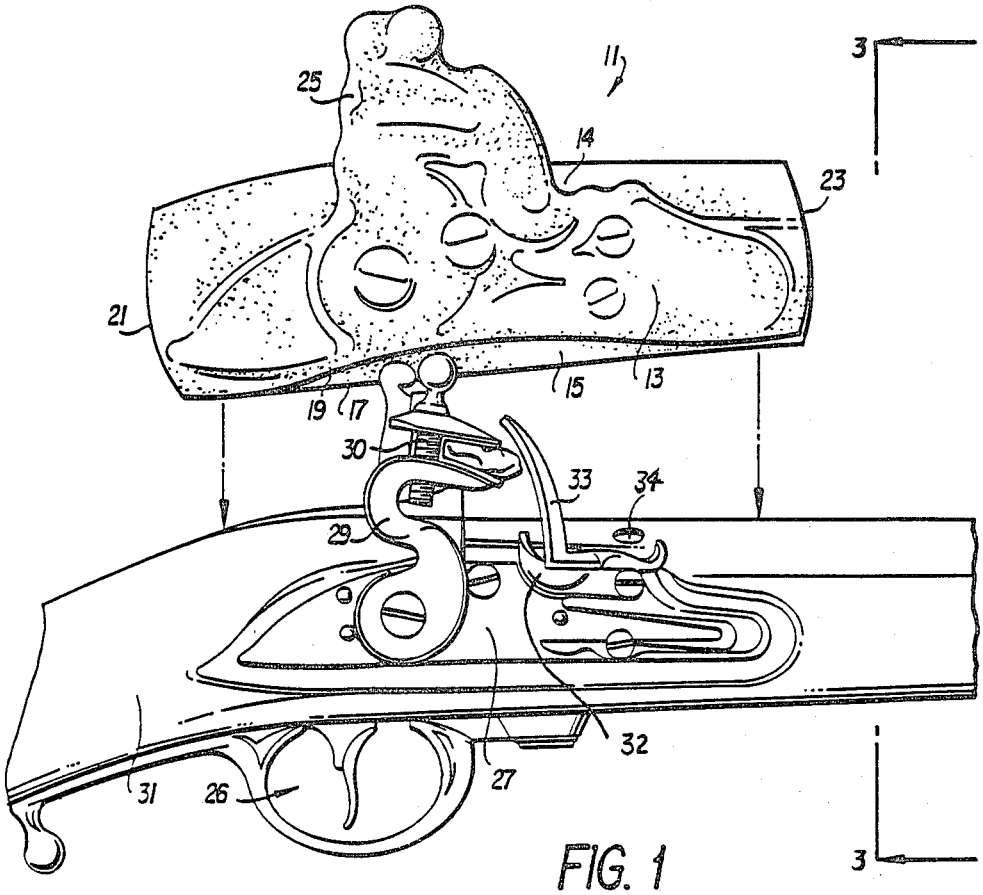
FIG. 1
FIG. 2
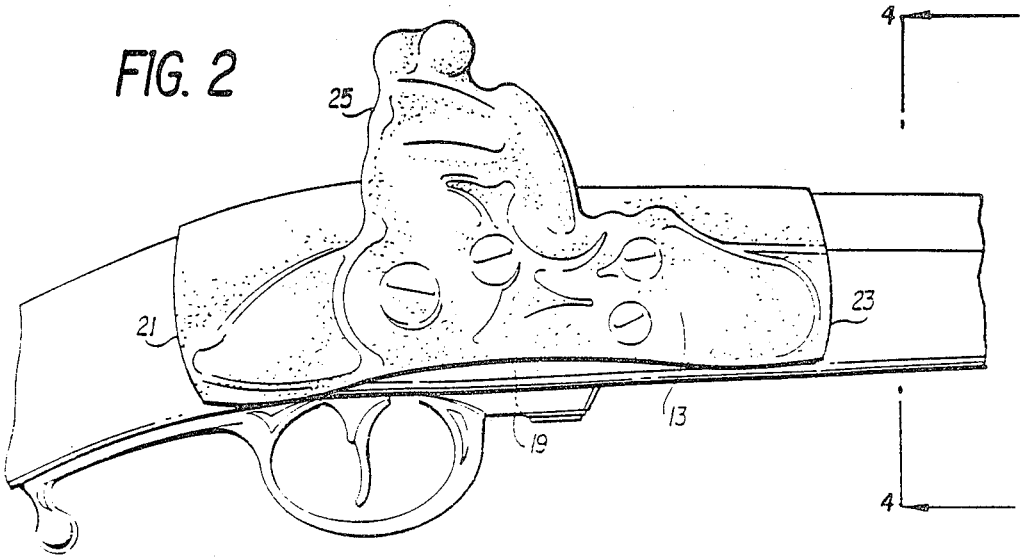

WEATHER SHIELD FOR THE FIRING MECHANISM OF A GUN AND ITS METHOD OF MANUFACTURE

BACKGROUND OF THE INVENTION

The exterior portions of the firing mechanism, including the hammer structure of a gun, particularly an antique gun of the flint striking variety, is often subject to severe environmental hazards such as rain, snow, dust, dirt, etc. While periodic cleaning and oiling of the firing mechanism helps diminish possible harmful environmental effects, there are often times when the weapon cannot be immediately serviced, e.g., when on mock field manuevers, which may result in damage to the firing mechanism. Moreover, in the case of antique firearms which rely on the striking of a flint, moisture in the form of rain or snow may actually prevent firing of the weapon when the trigger is pulled. In addition, the exterior portion of the firing mechanism is also subject to damage if the gun is dropped or accidently struck and the hammer structure may also be accidently cocked for firing when not intended.

The present invention has been devised to overcome these problems and an object thereof is the provision of a resilient weather shield which is adapted to completely cover the exterior firing mechanism of a gun to protect it from environmental factors such as dirt, dust, rain, moisture as well as accidental shocks and blows which may be imparted thereto. Although having general applicability to any firing mechanism, the weather shield of the invention is most particularly suitable to protecting the delicate and time worn exterior firing mechanisms of antique weapons.

In addition to providing a reliable weather shield, an additional object of the invention is to provide a weather shield which can be economically and cheaply manufactured from conventional plastics materials.

Yet another object of the invention is to provide a method for manufacturing the above weather shield which is simple, reliable, and economical.

These and other objects and advantages will be apparent from the following detailed description of the invention when read in connection with the accompanying drawings.

BRIEF DESCRIPTION OF THE DRAWINGS

FIG. 1 is a side view of a weather shield of the invention showing its relation to the exterior firing mechanism of a gun which it is designed to protect;

FIG. 2 illustrates the weather shield of the invention in its state of covering the firing mechanism of a gun;

DETAILED DESCRIPTION OF THE INVENTION

Figure 3:
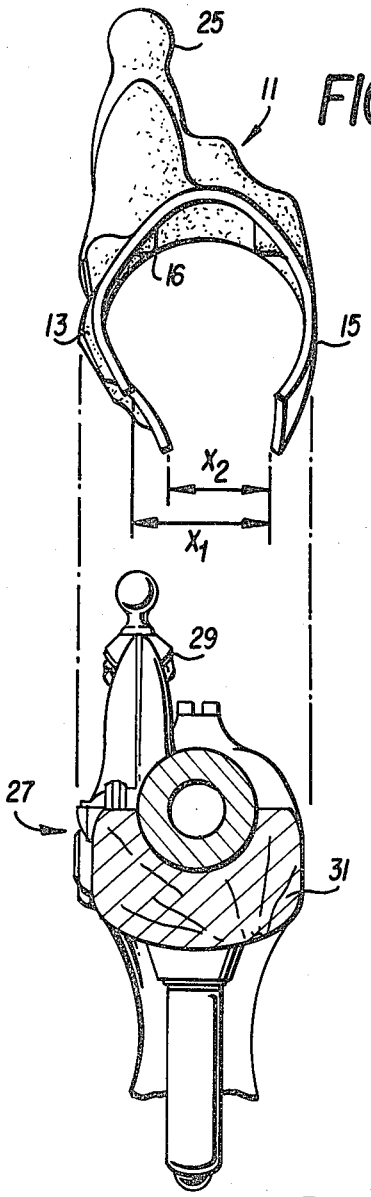
FIG. 3 is a sectional view taken along the lines 3—3 of FIG. 1.

An exemplary embodiment of the invention is illustrated in FIG. 1 for use with an antique rifle 31 including a firing mechanism 27 formed by exterior ignition elements 29, 30, 32, 33 and 34. The firing mechanism includes a rotatable serpentine shaped hammer portion

29 including a flint holding clamp 30, a strike plate 33 a charge pan 32 and a port 34. Hammer portion 29 is spring loaded and locked in an upright position and is released from this locked position upon activation of trigger 26 in a known manner to cause the flint to strike the striking plate 33 creating a spark which ignites a charge within the charge pan which in turn ignites a charge within the barrel of the rifle via port 34, as well known. It should be noted that although a representative firing mechanism has been illustrated, it is only for the purposes of explanation as the invention can be adapted for use with any type of firearm external firing mechanism.

Figure 4:
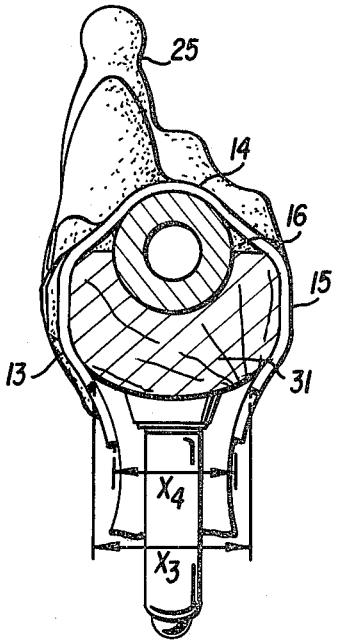
FIG. 4 is a sectional view taken along the lines 4—4 of FIG. 2.

The firing mechanism 27 is entirely covered and protected by a unitary weather shield 11 which includes an elongated generally C-shaped body section including a rounded top portion 14 and integrally depending curved sidewalls 13 and 15. The C-shaped cross section allows the body 11 to descend down around the side of the firearm in a manner to completely encase the firing mechanism 27 including hammer 29 as illustrated in FIG. 2 and 4. Top portion 14 includes a protruding portion 25 covering the protruding hammer 29. The body 11 includes edge portions 17, 19, 21 and 23 respectively defining its perimeter, which edge portions are designed to closely conform to and contact with the exterior surface of the rifle to provide both an adequate sealing of the firing mechanism from the external environment as well as a friction fit gripping of the body 11 to the rifle.

The sidewalls 13 and 15 of the body 11 have a natural tendency to curve inwardly when the cover is removed from the rifle requiring that they expand slightly during mounting. This is illustrated in FIGS. 3 and 4 where the inside widthwise extend of body 11 ($X_1$ for the front and $X_2$ for the rear) has a dimension slightly less than the corresponding widthwise dimensions ($X_3$ and $X_4$) of the rifle exterior. This natural inward bias of the sidewalls 13 and 15 thus results in a good conformance of the sidewalls to the exterior shape of the rifle as the sidewalls also continue to press inwardly after mounting.

Figure 5:
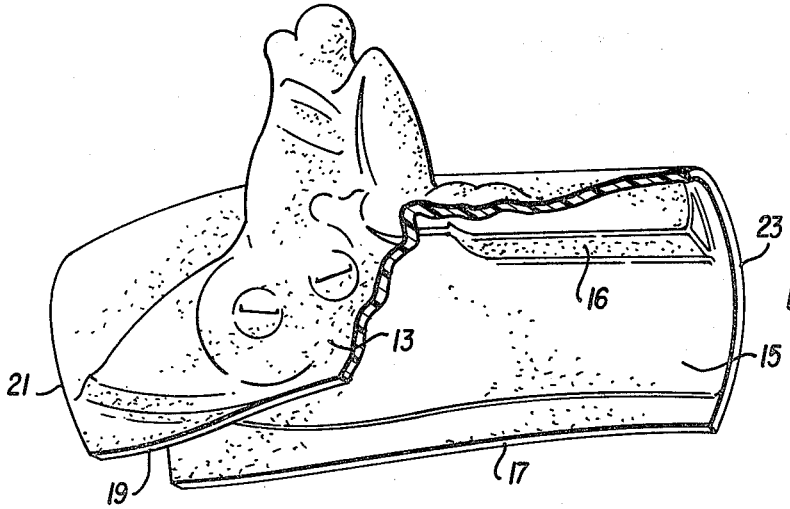
FIG. 5 is perspective view showing some interior detail of the weather shield; and, FIG. 6 illustrates a method of manufacturing the weather shield of the invention.

The interior profile of body 11 is closely configured to the exterior profile of the rifle. An example of the conformance of the two can be seen in FIGS. 3 and 5, the latter particularly showing a portion of the interior profile and ridges 16 thereon which conform with complementary surfaces on the exterior of the rifle. By closely conforming the interior profile of cover 11 with the exterior profile of the rifle, a surer fit of the cover is achieved and, in addition, additional friction is provided against untimely removal of the cover.

Figure 6:
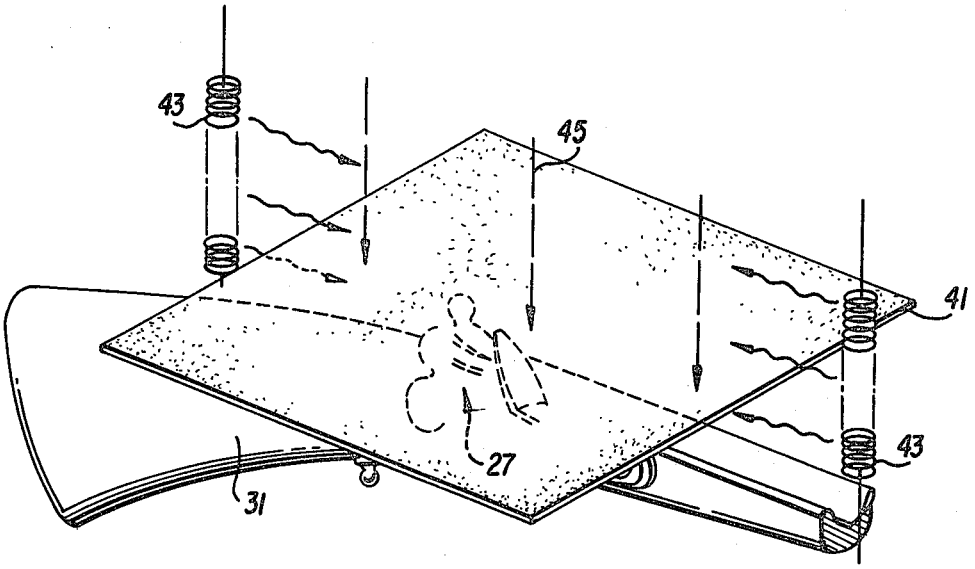

The body 11 is preferably constructed as a one piece molded unit, as illustrated in the drawings, and is formed of a resilient plastic material, preferably a thermoplastic material and more preferably an acrylic thermoplastic material such as used to make mouthguards. The thermoplastic material permits the use of a simple and inexpensive process for manufacturing body 11. This process, schematically illustrated in FIG. 6, includes cutting a piece of thermoplastic material, to a size sufficient for body 11 to completely cover the firing mechanism 27 when finally molded. The cut sheet 41 of material is then loosely placed over the firing mechanism 27 and the firing mechanism and thermoplastic sheet are placed in a vacuum chamber and heated by heat source 43. Heating of the thermoplastic sheet causes it to begin to conform to the exterior surfaces of rifle 31 including firing mechanism 27 and a vacuum is then applied to the chamber containing the rifle and sheet causing application of conforming pressure 45 to the softened thermoplastic sheet and its conformance to the exterior surfaces of the rifle. After the molding of the thermoplastic sheet to the contours of the rifle, including the firing mechanism 27, the applied heat and vacuum are removed and the now molded thermoplastic sheet is cooled. A particularly suitable device for providing the vacuum and heating functions is a commercially available apparatus known as the OMNI-VAC.

The thermoplastic material used to form the weather shield should preferably have some resiliency after being cooled to permit flexibility of body 11 during mounting on and removal from the rifle. As noted, an acrylic thermoplastic has been found to be particularly suitable for use in the invention as it remains soft and pliable even after being molded to the shape of the exterior of the rifle.

In lieu of using a vacuum for molding the thermoplastic material as described above, the material may first be heated and then manually deformed by hand or machine pressure to conform to the rifle and cooled by application of a wet fabric, e.g. a towel during the latter stages of the molding process.

The completed cover, which is simply and economically manufactured, provides an adequate protection of the firing mechanism of a gun from environmental influences such as dust, dirt, rain, moisture, etc. providing a highly effective weather shield structure. Moreover, since the material selected for the weather shield is preferably soft and pliable even when molded and shaped, a resilient protective covering is provided protecting the firing mechanism from blow and shocks caused by impacts with other objects. The weather shield is adequately maintained in place on the gun by the conformance of the interior of the body portion to the exterior surfaces of the gun portion and by the natural bias of the weather shield into a conforming relationship about a portion of gun on which it is mounted.

Although a preferred embodiment of the invention has been illustrated above, it should be understood that the invention is not limited thereto. The invention is particularly not limited to a weather shield for the particular firing mechanism illustrated in the drawings as this is merely representative of one suitable use of the invention. Other firing mechanisms can be likewise protected by the invention and accordingly the invention is not limited by the above description, but is only limited by the appended claims.

We claim:

1. A removable weather shield for protecting exterior ignition elements forming a firing mechanism of a firearm, said ignition elements including a hammer, a flint clamp, a strike plate, a charge pan and a port adjacent said charge pan and communicating with an interior bore of said firearm, said weather shield comprising:

a one-piece resilient shield body having a linear extent exceeding the linear extent of said exterior ignition elements of said firearm and a generally C-shaped cross sectional shape formed by a generally curved continuous top and integrally connected depending side walls, said shield body having an interior profile substantially conforming to an exterior profile of a portion of said firearm containing said ignition elements and providing a friction fit between the interior of said body and an exterior portion of said firearm including said ignition elements, the sidewalls of said body being separated by a widthwise interior space which has a dimension slightly less than the widthwise dimension of said firearm portion and being slightly deformable against a natural bias of said body to permit expansion of said widthwise dimension for aiding in mounting and removal of said shield to and from said firearm, said shield, when mounted on said firearm, covering and protecting said ignition elements from the environment, said natural bias causing said sidewalls to press against the sides of said firearm portion when said body is mounted in place.

2. A weather shield as in claim 1 wherein the peripheral edges of said body are configured to substantial contact with said firearm portion when said body is mounted thereto.

3. A weather shield as in claim 2 wherein said body is formed of a plastic material.

4. A weather shield as in claim 3 wherein said body is formed of a thermoplastic material.

5. A weather shield as in claim 4 wherein said thermoplastic material is an acrylic.

* * * * *